US006557450B1

(12) United States Patent
Cox et al.

(10) Patent No.: US 6,557,450 B1
(45) Date of Patent: May 6, 2003

(54) POWER INDICATING SETTER SYSTEM FOR INDUCTIVELY-FUZED MUNITIONS

(75) Inventors: Gary M. Cox, Bedford, IN (US); Larry Phillips, Loogootee, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/073,289

(22) Filed: Feb. 13, 2002

(51) Int. Cl.[7] ..... F42C 17/00

(52) U.S. Cl. ..... 89/6.5; 102/215; 102/270; 89/6

(58) Field of Search ..... 89/6.5, 6; 102/215, 102/270

(56) References Cited

U.S. PATENT DOCUMENTS 4,479,264 A * 10/1984 Lockett et al. ..... 359/174
4,495,851 A * 1/1985 Koerner et al. ..... 89/6.5
4,649,796 A * 3/1987 Schmidt ..... 89/6.5
4,664,013 A * 5/1987 Wegner et al. ..... 89/6.5
4,862,785 A * 9/1989 Ettel et al. ..... 89/6.5
4,985,922 A * 1/1991 Kolbert ..... 380/59
5,241,892 A * 9/1993 Ousterhout ..... 89/6.5
5,247,866 A * 9/1993 O'Malley ..... 89/6
5,343,795 A * 9/1994 Ziemba et al. ..... 89/6.5
5,497,704 A * 3/1996 Kurschner et al. ..... 102/264
5,894,102 A * 4/1999 Oberlin et al. ..... 89/6.5
5,933,263 A * 8/1999 Kinstler ..... 359/142
6,176,168 B1 * 1/2001 Keil et al. ..... 89/6.5
6,268,785 B1 * 7/2001 Kollman et al. ..... 336/83

* cited by examiner

*Primary Examiner*—Michael J. Carone
*Assistant Examiner*—Troy Chambers
(74) *Attorney, Agent, or Firm*—Crane L. Lopes, Esq.

(57) ABSTRACT

A power indicating setter system monitors the power level of a fuze setter coil of a fuze setter system for a gun operable to fire inductively-fuzed shells. The fuze setter system transmits a carrier signal that induces magnetic field power in the fuze setter coil. The strength of the magnetic field power correlates to reliability of the fuze setter system to transmit fuzing data to the shells. The fuze setter coil induces a signal in an adjacent induction element. Circuitry, coupled to the induction element, operates to compare the signal to a calibrated signal produced by the circuitry. The circuitry, by a power indicator, functions to indicate to an operator when the value of the signal is greater than the calibrated value. The power indicator indicates during operation of the gun, thereby informing the operator of the reliability of the fuze setter system to transmit fuzing data to the shells.

20 Claims, 3 Drawing Sheets

POWER INDICATING SETTER SYSTEM FOR INDUCTIVELY-FUZED MUNITIONS

CROSS-REFERENCE TO RELATED APPLICATIONS

Not applicable.

STATEMENT OF FEDERALLY SPONSORED RESEARCH AND DEVELOPMENT

The invention claimed and disclosed herein may be manufactured and used by, or on behalf of, the Government of the United States of America for government purposes without the payment of any royalties thereon or therefor.

REFERENCE TO SEQUENCE LISTING, A TABLE, OR A COMPUTER PROGRAM LISTING COMPACT DISK APPENDIX

Not applicable.

BACKGROUND OF THE INVENTION

The present invention relates generally to a system for monitoring inductive fuze setter systems for large-caliber guns, and more particularly to an apparatus and process for continuously monitoring and indicating the power level of a fuze setter system of large-caliber guns configured to fire inductively-fuzed shells.

Inductive fuze setter systems are known and have been used for setting fuzes in shell munitions for large caliber guns. For instance, a typical inductive fuze setter system is installed in the gun mount of the 5-inch 54 caliber Mark (Mk) 45 gun used aboard United States Navy vessels. The fuze setter system is used to pass fuzing data to and from inductively set fuzes of shells fired by the gun.

Hereinafter in this application, such large-caliber guns are collectively referred to as "gun" or "guns," as grammar and form requires. Technically, the term "gun" is understood, within the scope of this application, to mean barrel and rifle weapons of the military type described previously, but may also encompass mortar-type devices, and any other type of gun that fires inductively-fuzed rockets, missiles or equivalent weaponry.

The term "shell," means any kind of ammunition or munitions which is capable of carrying inductive fuze components and circuitry and is capable of receiving fuzing data inductively transmitted by a fuze setter system to the fuze of the shell.

The term "fuze" comprises any fuze known in the art that includes circuitry and components (e.g., a fuze coil) and other elements necessary to make the fuze operable to receive and send fuzing data inductively to the fuze setter system of the gun.

A typical fuze setter system, in a gun such as the Mk 45 system described previously, includes a fuze setter coil. Generally, the fuze setter system, including the fuze setter coil, is disposed within the gun mount so that the fuze setter coil is further disposed in close proximity to the shells as the shells are prepared for loading into the breech of the gun for firing.

The fuze setter coil may be connected as part of an R-L-C resonant circuit, and is operable to receive an excitation (carrier) signal from the fuze setter system. The carrier signal induces a magnetic field around the fuze setter coil, and the magnetic field is used to establish a data link with the fuze of the shell. The magnetic field induced in the fuze setter coil also functions to inductively power the circuitry and other components of the fuze of the shell. By the data link, fuzing data (forward data) may be transferred from the fuze setter system to the fuze of the shell, typically by the fuze setter system modulating the carrier signal. The fuze setter system may also receive data (reverse data) from the fuze of the shell, typically by the fuze effectuating phase-shift in the R-L-C circuit.

Therefore, in a typical inductive fuze setter system, the fuze setter system sends a carrier signal that induces a magnetic field in a fuze setter coil. The magnetic field establishes a data link with the fuze of the shell, and by the data link fuzing forward data and reverse data are communicated between the fuze setter system and the fuze of the shell. The fuze setter coil provides fuze-setting data to the fuze circuitry and also provides power for the fuze circuitry of the shell to function properly.

The strength of the magnetic field induced in a fuze setter coil by the fuze setter system, often referred to as coil "power," is typically measured (in milliwatts) during assembly of the fuze setter system by using a standard receiving coil connected to a standard receiving circuit. Standard receiving circuits are known in the art and are used to measure and calibrate fuze setter system circuitry during assembly and testing of the system. In this field of technology, for example, a standard receiving coil takes the place of the fuze coil and standard circuitry takes the place of the fuze circuitry.

Therefore, during assembly of the fuze setter system the standard receiving coil and receiving circuits may be used to test a fuze setter system's ability to induce sufficient magnetic field strength in a fuze setter coil, and thereby test the ability of the fuze setter coil to establish an adequate data link with the fuze circuitry of a shell.

Effective fuze setting is accomplished when the reverse data received by the fuze setter system from the fuze circuitry of the shell (by phase modulation) has the same content as the forward data sent by the fuze setter system to the fuze circuitry of the shell (by pulse-width modulation). If the reverse data contains different data than the forward data sent to the fuze circuitry of the shell, there is a probability that the fuze is not properly set, and consequently that the shell will not function properly when it is fired from the gun.

In past systems there are typically two types of problems associated with the operation of fuze setter systems to effectively send and receive data from the fuze circuit of inductively-fuzed shells. First, the data may be corrupted in some manner, whether forward data sent by the fuze data or reverse data received from the fuze of the shell.

Second, the data may be uncorrupted, but the power level induced by the fuze setter coil in the fuze circuitry of the shell is insufficient for the fuze circuit to function properly and thereby set the fuze of the shell. The strength of the magnetic field induced in the fuze setter coil by the carrier signal directly correlates to the ability of the fuze circuitry of the shell to accurately set the fuze of the shell. Therefore, monitoring the strength of the magnetic field induced in the fuze setter coil by the carrier signal is an effective way to determine if the data link is adequate for accurate forward and reverse data transmission.

A disadvantage of past fuze setter-systems is that they cannot, during operational use of the gun system, monitor the strength of the magnetic field induced in the fuze setter coil (setter coil power) by the carrier signal of the fuze setter system. In past systems, fuze setter coil power is measured only during electrical acceptance testing of the gun system or during installation of the fuze setter system, including the fuze setter coil.

In past fuze setter systems, the operability of the fuzing data link is typically verified by performing an End Around Test (EAT), which is initiated from an external control panel. However, the strength of the magnetic field induced by the fuze setter system in the setter coil, a critical parameter for reliable fuze setting, cannot be determined without a special test set. For example, measurement of fuze setter coil power has typically required special test equipment. The special test equipment has been provided separately from the gun mount and fuze setter system and is often bulky and difficult to transport and use.

Typically, either a manual test set or a computer-based test set has been used to test fuze setter coil power in past fuze setter systems. The manual test set of past fuze setter systems includes a suitcase tester, standard receiver (coil and circuitry), two digital multimeters, and interconnecting cables. The computer-based test set of past fuze setter systems includes a laptop digital microcomputer, standard receiver, interface box, and interconnecting cables.

A disadvantage of both test sets, however, is that they are bulky and require setup time and specialized skills/training to operate. Furthermore, to perform this measurement on a fuze setter system installed in an operational gun, a field service representative has to travel on-site with one of the two types of test sets identified previously. When either of the two test sets disclosed previously is used to test fuze setter coil power, the gun cannot be fired or otherwise operated during testing.

Therefore, past fuze setter systems do not have a built-in apparatus or process for monitoring and indicating fuze setter coil power of the fuze setter system. Typically in past systems the fuze setter coil power is checked during electrical acceptance testing of the gun mount or during installation of the fuze setter system.

Another disadvantage of past systems is that the fuze setter coil power may only be checked by use of external manual or computer test sets, both requiring considerable expense and expertise to use. Use of such test sets to test fuze setter coil power also requires the shells to be removed from the transfer station of the gun mount, and thus requires the gun be inoperable during the testing process.

Information relevant to attempts to address these problems can be found in U.S. Pat. Nos. 4,479,264, 4,985,922, 4,495,851 and 5,933, 263. However, each one of these references suffers from one or more of the following disadvantages:

U.S. Pat. No. 4,479,264, issued to Lockett et al on Oct. 23, 1984, discloses a transducer apparatus for optical data transmission, wherein an optical signal is used to measure the physical parameters of a control system. Lockett does not, however, disclose a display used to indicate to an operator if sufficient power is generated during optical signal transmission to accurately measure the control system.

U.S. Pat. No. 4,495,851, issued to Koerner et al on Jan. 29, 1985, discloses an apparatus that uses a microwave 'signal for setting and/or monitoring the operation of a shell fuze or detonator. Koerner does not, however, disclose a local, remote or hand-held display to indicate to an operator if sufficient microwave power is generated to properly set the fuze or detonator.

U.S. Pat. No. 4,985,922, issued to Kolbert on Jan 15, 1991, discloses an inductive coupling for bidirectional signal transmission through the skin of an aircraft. Kinstler does not, however, disclose a local, remote or hand-held display to indicate to an operator if the signal transmission is sufficient to accurately operate the pick-up unit located on the interior skin surface of the aircraft.

U.S. Pat. No. 5,933,263, issued to Kinstler on Aug. 3, 1999, discloses a self-powered datalink activation system that includes power accumulation and power distribution apparatuses. Kinstler does not, however, disclose a local, remote or hand-held display to indicate to an operator if sufficient power is accumulated and/or distributed to accurately operate the host weapon's electronics assembly.

In contrast, the present invention overcomes these problems by using a power indicator to indicate to an operator, during operation of the gun system, when the power level of the fuze setter system is adequate to ensure that the fuze setter system is reliably transmitting fuzing data to and from the fuze of the shell. The present invention discloses an apparatus and process that enables an untrained operator to conveniently and quickly monitor the power level of the fuze setter system, and thereby ensure that the fuze setter system is reliably transmitting fuzing data to and from the fuze of the shell. The present invention uses a local or remote power indicator to continuously indicate the power level of the fuze setter system.

By the present invention, the power level of the fuze setter system is conveniently and inexpensively indicated, without needing time-consuming manual or computerized tests by field service representatives. The present invention may be effectively used while the gun is in operation, without necessitating removal of shells from the gun mount. The power indicator of the present invention may also be configured to indicate to an operator when the fuze setter system is transmitting forward data to the fuze of the shell.

The power indicator of the present invention is coupled to monitor circuitry, and said circuitry is configured to monitor the power level induced in an induction element disposed proximate to the fuze of a shell within the gun mount. The fuze setter system induces power in the induction element, and thereby provides power to the monitor circuitry and the power indicator. Therefore, this invention does not require a separate power source to indicate to an operator the power level of the fuze setter system. Rather, this invention conveniently uses the existing fuze setter system of the gun to inductively power the monitor circuitry and the power indicator.

For the foregoing reasons there is a need for an apparatus and process for monitoring inductive fuze setter systems for large-caliber guns, and more particularly for an apparatus and process for inexpensively, conveniently and continuously monitoring and indicating to an operator the power level of the fuze setter system of a gun operable to fire inductively-fuzed shells.

BRIEF SUMMARY OF THE INVENTION

The present invention is directed to an apparatus and process that satisfies the need to enable an operator to continuously monitor the adequacy of the power level of a fuze setter system during operation of a gun system firing inductively-fuzed shells. The present invention is further directed to an apparatus and process wherein said monitoring may be accomplished during operation of the gun: without requiring removal of the shells from the gun mount, and without necessitating separate manual or computer-based tests of the fuze setter system carrier signal power level by field service representatives.

Therefore, an object of the present invention is to continuously indicate to an operator the power level of the fuze setter system during operation of a gun.

An object of the present invention is to provide a power indicator that indicates the power level of the fuze setter system, wherein the power indicator does not have to be adjusted or calibrated by an operator during use.

Another object of the present invention is to indicate to an operator the power level of the fuze setter system while the shells are in the gun mount.

Still another object of the present invention is to indicate the power level of the fuze setter system, wherein indication is accomplished without separate manual or computer-based tests and without using specialized equipment to indicate the power level of the fuze setter system.

A further object of the present invention is to indicate to an operator when forward data is being transferred by the fuze setter system to the fuze of the shell.

Yet another object of the present invention is to provide remote or hand-held indication of the power level of the fuze setter system.

According to the present invention, the foregoing and other objects and advantages are attained by an apparatus comprising a housing, wherein an induction element is disposed on the housing. The induction element operates to sense a magnetic field in response to a carrier signal sent to a fuze setter coil. Circuitry is disposed in the housing, and the circuitry is coupled to the induction element. The circuitry operates to monitor the magnetic field strength generated in the induction element-by the carrier signal. A power indicator is disposed on the housing, and the power indicator is operated by the circuitry to indicate when the magnetic field strength induced in the induction element is greater than a calibrated value of the circuitry.

In accordance with another aspect of the invention the circuitry also includes a field strength comparator for comparing the magnetic field value induced in the induction element to the calibrated value produced by the circuitry. The field strength comparator includes at least one resistor operable for setting the calibrated value produced by the circuitry. In still another aspect of the invention the field strength comparator includes a variable resistor operable for varying the calibrated value produced by the circuitry.

One other aspect of the present invention is that the power indicator operable by the field strength comparator to indicate when the magnetic field value induced in the induction element is greater than the calibrated value produced by the circuitry.

In another aspect of the present invention, the power indicator includes an indicator light. The indicator light is operable to indicate when the carrier signal is being forward modulated during forward data transmission.

In yet another aspect of the present invention, the power indicator is located remotely from the housing.

An aspect of the present invention includes the induction element and the fuze setter coil disposed adjacently upon the housing.

Also disclosed herein is a power indicating setter system process that comprises inducing a magnetic field in an induction element; coupling the induction element to circuitry; configuring the circuitry to compare the value of the induced magnetic field to a calibrated value; and indicating by the circuitry when the value of the induced magnetic field is greater than the calibrated value.

In another aspect of the present invention, the act of inducing includes inducing the magnetic field in response to a carrier signal sent to a fuze setter coil.

In accordance with one other aspect of the present invention, the act of configuring further includes calibrating the calibrated value to a standard value.

In accord with yet another aspect of the present invention, the act of indicating includes indicating when the carrier signal is being forward modulated.

In still another aspect of the present invention the act of inducing also includes disposing the induction element and the fuze setter coil adjacently upon housing. The act of indicating may be accomplished remotely from the housing.

The power indicating setter system disclosed herein also comprises means for inducing a magnetic field in an induction element; means for coupling the induction element to circuitry; means for configuring the circuitry to compare the value of the magnetic field to a calibrated value; and means for indicating by the circuitry when the value of the magnetic field is greater than the calibrated value.

In another aspect of the present invention, the means for inducing includes inducing the magnetic field in response to a carrier signal sent to a fuze setter coil. The means for configuring includes means for calibrating the calibrated value to a standard value.

In still another aspect of the present invention the indicating means comprises means for indicating when the carrier signal is being forward modulated, and the means for inducing further comprises means for disposing the induction element and the fuze setter coil adjacently upon a housing.

The apparatus and process of the present invention, using circuitry powered by an induction element to operate a power indicator, thereby enables an operator to continuously monitor the adequacy of the fuze setter system carrier signal power level during operation of a gun firing inductively-fuzed shells. As described by the present invention, monitoring may be accomplished during operation of the gun: without requiring removal of the shells from the gun mount, and without necessitating separate manual or computer-based tests of the fuze setter system carrier signal power level by field service representatives.

BRIEF DESCRIPTION OF THE SEVERAL VIEWS OF THE DRAWINGS

These and other features, aspects and advantages of the present invention will become better understood with regard to the following description, appended claims and accompanying drawings where:

DETAILED DESCRIPTION OF THE INVENTION

Figure 1:
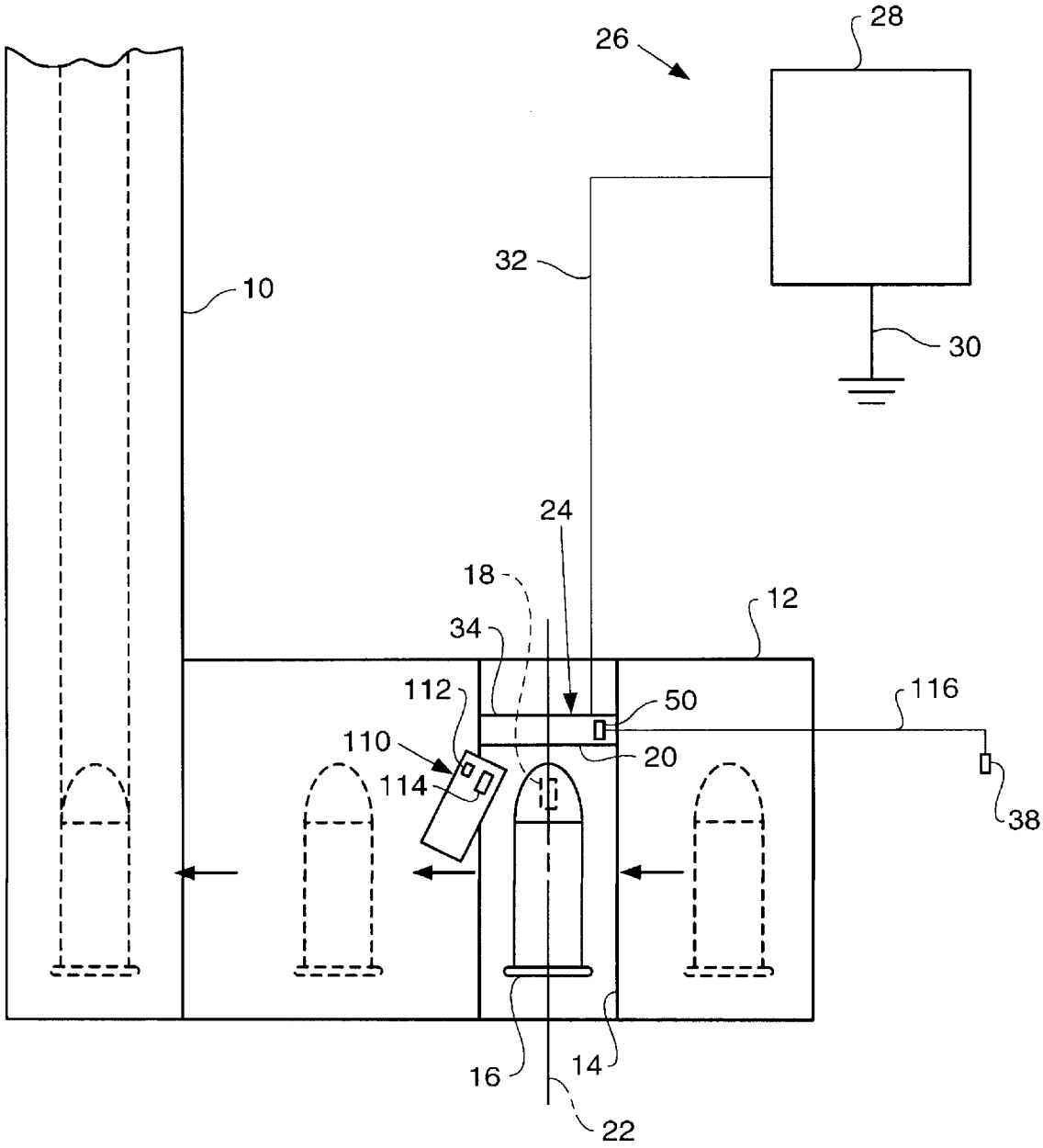
FIG. 1 shows a top sectional plan view of a gun, including the power indicating setter apparatus in accordance with the preferred and several alternative embodiments of the invention.

As shown in FIG. 1, gun 10 includes a gun mount 12 and a fuze setter system 26. Gun mount 12 is configured to transport a shell 16 to the transfer station 14, where shell 16 is briefly stopped at a fuzing location 22 for fuzing. Shell 16 includes a fuze 18 operable to receive and send fuzing data from and to fuze setter system 26. Fuze setter system 26 comprises a setter unit assembly 28 connected to a ground 30. Setter unit assembly 28 is operable to send and receive a carrier signal comprising fuzing data to fuze 18 via a cable 32 and a fuze setter coil 34. Fuze setter coil 34 is disposed within a coil form 20 of power level monitor 24. Following fuzing by fuze setter system 26, shell 16 is further transported by gun mount 12 to the breech of gun 10 for firing.

FIG. 1 illustrates the preferred and several alternative embodiments of the invention for monitoring the power level of fuze setter coil 34. In the preferred embodiment of the invention, power level monitor 24 is operable to energize a power indicator 50. In a first alternative embodiment of the invention, a hand power level monitor 110 comprises a hand power indicator 112 and an operational indicator 114. In a second alternative embodiment of the invention, a remote power indicator 38 is coupled by a remote cable 116 to power level monitor 24.

In any of the described embodiments of the present invention, power level monitor 24 functions to monitor the power level induced in fuze setter coil 34 by the carrier signal sent and received by fuze setter system 26. The power level is a critical parameter for reliably fuzing fuze 18 of shell 16. Accordingly, by the present invention the adequacy of the power level is indicated to an operator by power indicator 50, by hand power indicator 112, or by remote indicator 38. An operator is thereby informed if adequate power is being induced in fuze setter coil 34 by fuze setter system 26 for reliable fuzing of fuze 18 of shell 16.

Referring further to FIG. 1, fuze setter system 26 may comprise any fuze setter system capable of inductively fuzing shell 16. For example, the U.S. Navy's Mk 34 fuze setter system is known to those skilled in the art. Those skilled in the art will further appreciate that cable 32 may be replaced by any means suitable for sending and receiving fuzing data to shell 16 by fuze setter coil 34. For instance, cable 32 typically comprises electrical cable, but may be replaced by any suitable radio frequency means suitable for sending and receiving fuzing data. Similarly, remote cable 116 may be replaced by any physical, radio frequency or microwave means suitable for transmitting power status data from power level monitor 24 to remote indicator 38.

Power level monitor 24 is substantially disposed in the existing structure of transfer station 14 of gun mount 12 and preferably replaces the existing fuze setter coil apparatus. For instance, in the U.S. Navy 5-inch 54 caliber Mk 45 gun mount, power level monitor 24 is made to replace the Mk 34 Mod 0 fuze setter system setter coil and setter coil cover.

The physical dimensions and fabrication materials of power level monitor 24 are chosen to favorably adapt it for use in the existing structure of gun 10, typically within the existing housing and coil form. For instance, the Figures of this application illustrate the physical dimensions of the present invention as adapted to replace the fuze setter system setter coil of the U.S. Navy's Mk 34 Mod 0 fuze setter system. However, those skilled in the art will recognize that the physical dimensions and fabrication materials of power level monitor 24 and the other elements of the present invention described herein may be alternatively configured to thereby adapt the invention for use in any gun capable of firing inductively-fuzed shells.

Figure 2A:
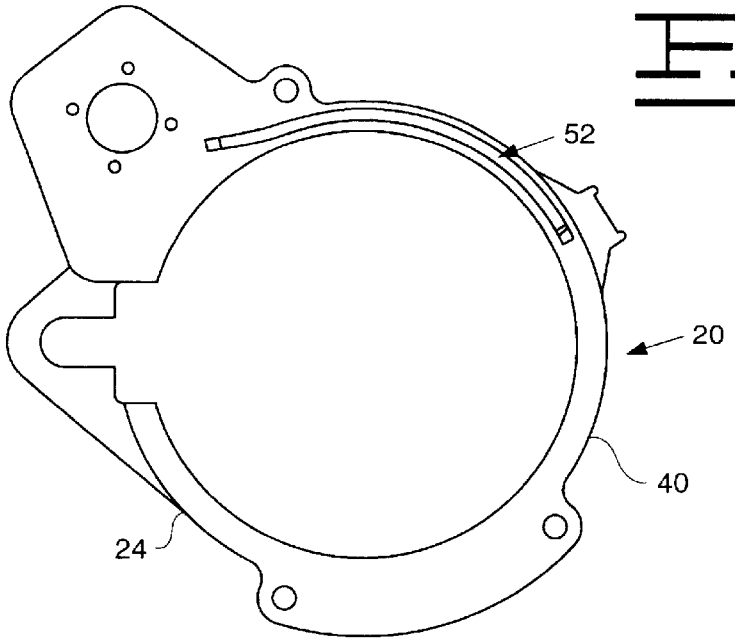
FIGS. 2(*a–c*) show top plan, elevation and bottom partial-sectional plan views of the housing in accordance with the present invention.
Figure 2B:
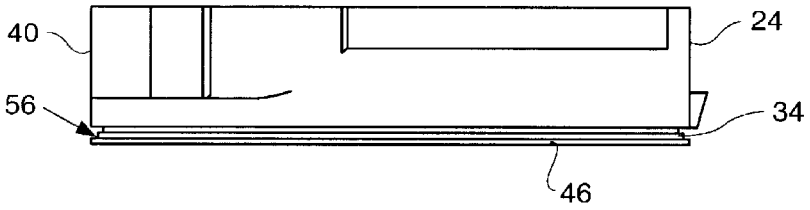
Figure 2C:
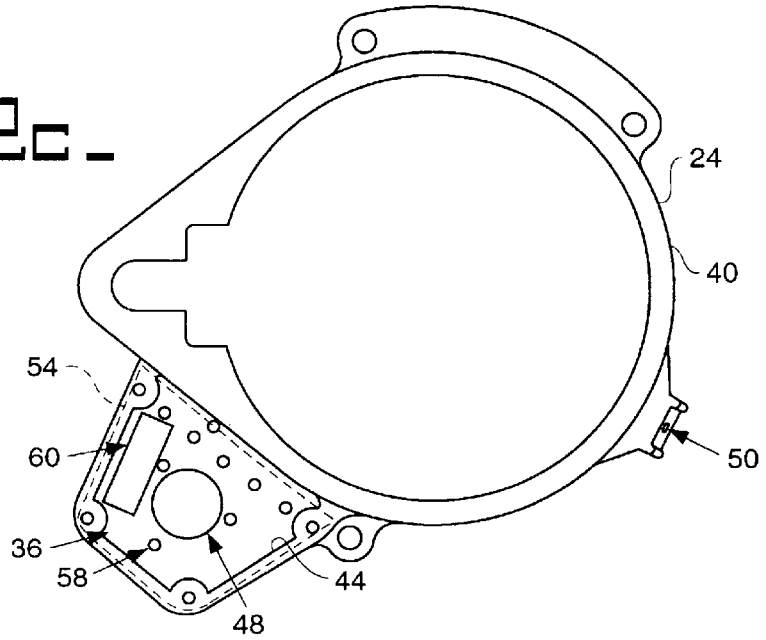

FIGS. 2(*a–c*) show top plan, elevation and bottom partial-sectional plan views of housing 40 of the present invention. Referring to FIGS. 2(*a–c*), housing 40 comprises coil form 20 groove 56 and component cavity 44. Groove 56 is formed in coil form 20 of housing 40 and functions to receive fuze setter coil 34. Power level monitor 24 is disposed on housing 40. Power level monitor 24 comprises induction element 46 and monitor circuitry 36.

Monitor circuitry 36 is disposed substantially within component cavity 44. Monitor circuitry is coupled to induction element 46. Induction element 46 and fuze setter coil 34 are disposed adjacent to each other and substantially within groove 56 of coil form 20. Monitor circuitry 36 is further coupled to power indicator 50 by electrical wiring or similar means that is run through slot 52 formed in housing 40.

Referring to FIG. 2(*b*), fuze setter coil 34 comprises a plurality of windings of electrically conductive ductile material suitable for transmitting and receiving fuzing data between fuze setter system 26 and fuze 18 of shell 16 of FIG. 1. In the preferred embodiment of the present invention, fuze setter coil 34 comprises a primary winding of twenty-four turns of 20 AWG magnet wire and a secondary winding of two turns of 22 AWG magnet wire, both windings being concentrically disposed (preferably by winding) into groove 56.

Also preferably, induction element 46 comprises three turns of 26 AWG magnet wire wound concentrically adjacent to and about fuze setter coil 34 substantially within groove 56. Induction element 46 functions to receive induced electrical (alternating current) power from fuze setter coil 34. Those skilled in the art will realize that fuze setter coil 34 and induction element 46 may comprise any number of windings and spacing relative to each other to optimize inductive transfer of electrical power between them.

Referring to FIG. 2(*b*) and 2(*c*), induction element 46 is coupled to monitor circuitry 36 within component cavity 44 by turret terminals 58. Fuze setter coil 34 is routed into component cavity 44 and coupled to turret terminals 58. A series capacitor 60 is fastened within component cavity 44 by turret terminals 58. A cover 54 is used to protect monitor circuitry 36 and series capacitor 60 within component cavity 44 from ambient environmental and operational conditions.

Referring again to FIGS. 2(*b*) and 2(*c*), monitor circuitry 36 preferably comprises solid-state electronic components mounted on an integrated Printed Wiring Assembly (PWA) (see the disclosure for FIG. 3 below for additional description of monitor circuitry 36). Monitor circuitry 36 functions to process electrical (alternating current) power received from induction element 46 and indicate to an operator, by power indicator 50, the power level of fuze setter coil 34. The PWA is preferably fastened within component cavity 44 and connected to induction element 46 by turret terminals 58.

Also preferably, component cavity 44 is be filled with potting compound or a similarly non-conductive inert material to secure monitor circuitry 36 and series capacitor 60 in place within component cavity 44 and thereby isolate said circuitry and capacitor from detrimental environmental and operational conditions.

Referring to FIGS. 2(*a*) and 2(*c*), slot 52 formed in housing 40 functions to guide electrical wiring from monitor circuitry 36 to power indicator 50. Preferably slot 52 is filled with potting compound or similar non-conductive inert material to secure the electrical wiring within slot 52. The electrical wiring functions to transmit power from monitor circuitry 36 and thereby energize power indicator 50. In the preferred embodiment of the present invention, power indicator 50 includes an indicator light, for instance a LED, suitable to be visually monitored by an operator from outside of gun mount 12 during operation of gun 10 of FIG. 1.

Alternative embodiments of power indicator 50 may include any other equivalent type of light—for instance, an incandescent light. Similarly, power indicator 50 may comprise a LCD or a digital or analog numerical display suitable for indicating to an operator the power level of fuze setter coil 34 of FIG. 2(*b*). Power indicator 50 may also comprise a plurality of such indicators. For example, a plurality of LED's may be coupled by the electrical wiring to monitor circuitry 36. Monitor circuitry 36 may then be configured to selectively energize any combination of the plurality of such power indicators to thereby indicate to an operator a range of power values of fuze setter coil 34.

As therefore illustrated by FIGS. 2(*a–c*), induction element 46 is preferably disposed adjacent to fuze setter coil 34, and both are wound concentrically in groove 56 of coil form 20 of housing 40. Fuze setter coil 34 receives electrical (alternating current) power from fuze setting system 26 of FIG. 1, and thereby inductively generates electrical (alternating current) power in induction element 46.

Induction element 46 is coupled to monitor circuitry 36 by turret terminals 58 within component cavity 44. Monitor circuitry 36 receives (alternating current) electrical power from induction element 46. Monitor circuitry 36 is coupled to power indicator 50 by wiring guided within slot 52. Monitor circuitry 36 is operable to energize power indicator 50 to indicate to an operator the power level of fuze setter coil 34.

Figure 3:
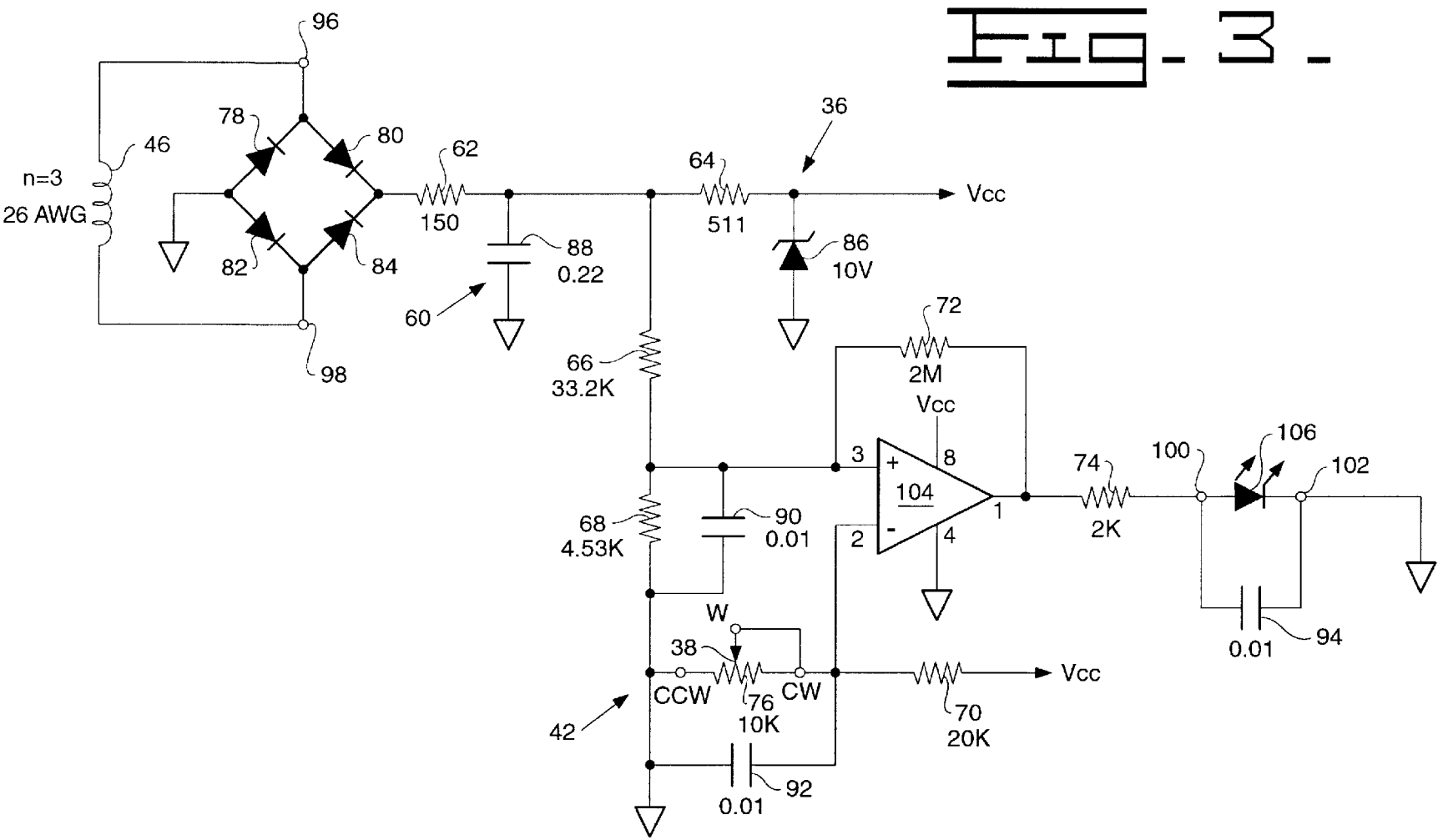
FIG. 3 shows a schematic circuit diagram of the monitor circuitry in accordance with the present invention.

FIG. 3 shows a schematic circuit diagram of monitor circuitry 36 in accordance with the present invention. In the preferred embodiment of the present invention, monitor circuitry 36 comprises a plurality of integrated circuit components, as described below, all which are interconnected and mounted together on the PWA. The PWA is secured within component cavity 44 of FIG. 2(*c*) as described previously.

In reference to FIG. 3, induction element 46 is coupled to a bridge rectifier comprising diodes 78, 80, 82 and 84 (hereinafter referred to as bridge rectifier 78–84) by terminals 96 and 98 (terminals 96 and 98 correspond to several of the turret terminals 58 illustrated by FIG. 2(*c*)). Bridge rectifier 78–84 functions to full-wave rectify alternating current power received from induction element 46 and transmit equivalent direct current power (hereinafter DC signal) to a resistor 62 and a fixed capacitor 88. Resistor 62 and capacitor 88 function to filter the DC signal.

In further reference to FIG. 3, the DC signal, which represents the power level in induction element 46—and thereby power level in fuze setter coil 34 of FIG. 2(*b*), is sent from resistor 62 to a resistor 64 and to a resistor 66. Resistor 62 and resistor 64 function to determine the loading on induction element 46 and thereby scale the DC signal. The DC signal is fed from resistor 64 a zener diode 86. In the preferred embodiment of the present invention, zener diode 86 functions to provide a calibrated 10-volt DC signal (illustrated as $V_{cc}$) to a field strength comparator 104 and to a resistor 70.

Field strength comparator 104 is an operational amplifier of any suitable type known to those skilled in the art. Preferably, said operational amplifier is the LM158 amplifier described in the Monitor Circuitry Parts List infra. However, field strength comparator 104 may comprise any operational amplifier having an impedance greater than or equal to the LM158, being capable of functioning using a single supply source (e.g., $V_{cc}$), and having supply-current draw less than or equal the LM158.

A reference voltage to the inverting input (illustrated as numeral 2) of field strength comparator 104 is set by the voltage divider of resistor 70 and a field strength calibrator 42. Field strength calibrator 42 includes a variable resistor 76. Variable resistor 76 is typically pre-calibrated using calibrator 38 so that resistor 70 and field strength calibrator 42 together feed a reference voltage to the inverting input of field strength comparator 104. Resistor 66 and a resistor 68 function together to feed the DC signal to the non-inverting input (illustrated as numeral 3) of field strength comparator 104.

In continued reference to FIG. 3, field strength comparator 104 thus receives DC signals at its inverting and non-inverting inputs, respectively illustrated as numerals 2 and 3 of field strength comparator 104. A calibrated DC signal is fed to the inverting input by field strength calibrator 42, and the DC signal, representing power in fuze setter coil 34 of FIG. 2(*b*), is fed into the non-inverting input by resistor 66 and resistor 68. Field strength comparator 104 functions to compare the voltages of the DC signals fed to said inverting and non-inverting inputs. When the non-inverting input voltage is greater than the inverting input, field strength comparator 104 is operable to generate a signal output (illustrated by numeral 1), preferably about 8.6 volts DC, sufficient to energize a Light Emitting Diode (LED) 106 (LED 106 of FIG. 3 is one of several embodiments of power indicator 50 illustrated by FIG. 2).

Conversely, when the non-inverting voltage input is less than the inverting input, field strength comparator 104 is operable to generate a signal output, preferably about 0.8 volts DC, that is sufficient to de-energize LED 106.

In this manner, field strength comparator 104 compares the voltage of the non-inverting input, representing the power level of fuze setter coil 34, with the voltage of the inverting input, representing the pre-calibrated voltage set by field strength calibrator 42. Field strength comparator 104 is operable to energize or de-energize LED 106, depending upon whether the non-inverting input voltage is higher or lower than the inverting input voltage of field strength comparator 104.

A resistor 72 functions to provide positive feedback (hysteresis) for field strength comparator 104. Resistor 72 functions to prevent output signal oscillations when the non-inverting input voltage is approximately the same as the inverting input voltage of field strength comparator 104. A resistor 74 functions to limit the output current of field strength comparator 104. Terminals 100 and 102 function to connect LED 106 to monitor circuitry 36. Capacitors 90, 92 and 94 function to filter signal noise that may be present within the DC signals transmitted by, fed by and compared by monitor circuitry 36.

In addition to illustrating the schematic arrangement and interconnection of circuit components of monitor circuitry 36, FIG. 3 depicts preferred voltage, resistance and capacitance values for the several circuit parts. For instance, zener diode 86 preferably operates to produce a regulated 10-volt (10V) output power. Resistor 74 is a 2000-ohm (2K) resistor. Capacitors 90, 92 and 94 are 0.01 microfarad capacitors.

Those skilled in the art will realize that other values for these and other parts of monitor circuitry 36 may be used, depending upon the configuration and operational capabilities of the gun at issue. In the preferred embodiment of the present invention, wherein the monitor circuitry is disposed in the U.S. Navy 5-inch 54 caliber Mk 45 gun mount, the following parts list, disclosing representative part numbers, part descriptions, quantities, and National Stock Number (NSN) corresponds to the parts of monitor circuitry 36 illustrated by FIG. 3 and described previously:

Monitor Circuitry Parts List

| COMMERCIAL PART NUMBER | FIG 3 No. | DESCRIPTION OF THE PART | QTY | NSN |
|---|---|---|---|---|
| JANTX1N6638 | 78–84 | Diode, Switching | 4 | 5961-01-315-9617 |
| JANTX1N4465 | 86 | Diode, Zener, 10 V, ±5% 1.5 W | 1 | 5961-00-333-9956 |
| LM158AJ/883B | 104 | Microcircuit, Op-Amp | 1 | 5962-01-126-3888 |
| M39014/01-1575V | 90–94 | Capacitor, 0.01 μF, 100 V, ±10% | 3 | 5910-01-313-6581 |
| M39014/02-1356 | 88 | Capacitor, 0.22 μF, 50 V, ±10% | 1 | 5910-00-113-5286 |
| RJR26FW103R | 76 | Resistor, Variable, 10 KΩ, 0.25 W, ±10% | 1 | 5905-01-184-3510 |
| RLR07C1500FS | 62 | Resistor, 150 Ω, 0.25 W, ±1% | 1 | 5905-01-170-7739 |
| RLR32C5110FS | 64 | Resistor, 511 Ω, 1 W, ±1% | 1 | 5905-01-208-5157 |
| RNC50H4531FS | 68 | Resistor, 4.53 KΩ, 0.05 W, ±1% | 1 | 5905-00-305-5315 |
| RNC50H2002FS | 70 | Resistor, 20 KΩ, 0.05 W, ±1% | 1 | 5905-00-758-2925 |
| RNC50H3322FS | 66 | Resistor, 33.2 KΩ, 0.05 W, ±1% | 1 | 5905-00-233-4517 |
| RLR05C2001FS | 74 | Resistor, 2 KΩ, 0.125 W, ±1% | 1 | 5905-01-176-3867 |
| RNC55H2004FS | 72 | Resistor, 2 MΩ, 0.1 W, ±1% | 1 | 5905-01-081-3628 |
| M55155/30-5 | 96–102 | Terminal, Turret | 4 | 5940-00-082-5094 |
| HLMP-1790 | 106 | LED, Green, T-1, 2 mA | 1 | 5980-01-267-8530 |
| MW016CSx000026n | 46 | Wire, Magnet, 26 AWG | 6 FT | 6145-00-360-7760 |
| M22759/11-26-0 | — | Wire, Electrical, 26 AWG, Black | 1 FT | 6145-00-968-6586 |
| M22759/11-26-2 | — | Wire, Electrical, 26 AWG, Red | 1 FT | 6145-00-968-6587 |
| M22759/11-26-9 | — | Wire, Electrical, 26 AWG, White | 1 FT | 6145-00-958-6007 |
| SMC170CTP | 106 | Lens, LED, T-1 | 1 | — |

In reference to FIG. 3, those skilled in the art will further realize that several of the parts of monitor circuitry 36 may be either adjusted or replaced. For example, variable resistor 76 of field strength calibrator 42 may be adjusted to change the inverting input voltage of field strength comparator 104. It may, for example, be advantageous to calibrate the inverting input voltage to correspond to a different DC signal input voltage at the non-inverting input of field strength comparator 104; to calibrate non-inverting voltage to a particular type of operational amplifiers that may be used for field strength comparator 104; or to optimize the output signal of field strength comparator 104 to energize any of the previously-described power indicators that may be used in place of LED 106.

Similarly, and again referring to FIG. 3, variable resistor 76 may be replaced with a fixed resistor or with a plurality of fixed resistors. The optimal resistance value for such fixed resistors may be determined by measuring the strength of the DC signal, which in turn corresponds to the field strength (power) level induced in induction element 46 by fuze setter coil 34 of FIG. 2(*b*). Typically, the field strength of induction element 46 is measured prior to assembly of the present invention by using a standard receiving coil and circuit of a type known in the art. For example and as previously described in the Background section, a standard receiving coil and circuit may be used to measure said field strength.

As discussed previously, FIG. 1 discloses several alternative embodiments of the present invention. In a first alternative embodiment of the present invention, hand power level monitor 110 comprises a hand power indicator 112 and an operational indicator 114. Hand power level monitor 110 functions like power level monitor 24 to monitor the power level induced in fuze setter coil 34 by the carrier signal sent and received by fuze setter system 26.

Preferably, hand power level monitor 110 is capable of being hand-carried by an operator, thereby enabling an operator to monitor fuze setter coil power level of any number of guns that otherwise have no such built-in monitoring capability. Hand power level monitor 110 may also be physically configured to facilitate it being disposed against the gun mount in a manner to facilitate accurate measurement of the power level of a fuze setter coil. For instance, the external geometry of hand power level monitor 110 may be configured to adapt it to fit into the shutters or other openings in vicinity of a fuze setter coil of a transfer station.

Hand power indicator 112 is analogous to power indicator 50 of the preferred embodiment of the present invention. Therefore, hand power indicator 112 functions to indicate to an operator if adequate power is being induced in fuze setter coil 34 by fuze setter system 26 for reliable fuzing of fuze 18 of shell 16.

In continued reference to FIG. 1, operational indicator 114 comprises any light or display known in the art that is suitable for indicating to an operator the operational status of hand power level monitor 110—for instance to indicate the ON/OFF operational status. Those skilled in the art will appreciate that hand power level monitor 110 includes an induction element and monitor circuitry configured similar to the circuitry illustrated by FIG. 3.

Thus, fuze setter coil 34 of FIG. 2(*b*) receives electrical power from fuze setting system 26 of FIG. 1, and thereby inductively generates (alternating current) electrical power in the induction element of hand power level monitor 110. Alternatively, hand power level monitor 110 may be provided with an independent power source to operate monitor circuitry therein. For instance, dry-cell batteries or similar direct current power devices may be used to provide such an independent power source.

In a second alternative embodiment of the present invention, remote power indicator 38 is coupled by a remote cable 116 to power level monitor 24. Remote indication may be desirable if an operator desires to monitor the power level of fuze setter coil 34 from a command and control location remote from gun 10—for instance, from the bridge of a ship, from a gun control bunker or from the control station of a military vehicle.

Remote power indicator 38 functions to monitor the power level induced in fuze setter coil 34 by the carrier signal sent and received by fuze setter system 26. Remote cable 116 may be replaced by any physical, radio frequency or microwave means suitable for transmitting power status data from power level monitor 24 to remote power indicator 38. Remote power indicator 38 comprises any type of light or display similar to those discussed previously for hand power indicator 112 and for power indicator 50 (refer to the previous discussion of FIG. 2(*c*)).

Referring collectively to FIG. 1, FIGS. 2(*a–c*) and FIG. 3, the preferred embodiment of the present invention is used in the following manner:

Gun 10 includes gun mount 12 and fuze setter system 26. Gun mount 12 operates to transport shell 16 to transfer station 14, where shell 16 is briefly stopped at a fuzing location 22 for fuzing. Shell 16 includes fuze 18 operable to receive and send fuzing data to fuze setter system 26. Fuze 18 is inductively-fuzed in a conventional manner by fuze setter system 26. Those skilled in the art recognize that fuzing is used to configure shell 18 to detonate at a predetermined altitude after firing, at a predetermined time interval after firing, upon impact on or nearby the target or upon the occurrence of similar post-firing events.

Fuze setter system 26 includes setter unit assembly 28 and cable 32. Power level monitor 24 is coupled to setter unit assembly 28 by cable 32 as part of a series R-L-C or similar resonant circuitry. Power level monitor 24 receives an excitation carrier signal, preferably about 100 kHz, from setter unit assembly 28. The carrier signal induces a magnetic field in fuze setter coil 34 and thereby induces an analogous magnetic field in fuze 18 of shell 16. Fuzing data is transmitted from fuze setter system 26 to fuze 18 (forward data) by modulating the carrier signal. Fuzing data is transmitted from fuze 18 to fuze setter system 26 (reverse data) by setter unit assembly 28 detecting and processing phase-shift in the R-L-C circuit of fuze setter system 26.

Fuze setter coil 34 is disposed proximate to fuze 18 within transfer station 14 in order to facilitate transmission of fuzing data to and from fuze 18. The distance between fuze setter coil 34 and fuze 18 correlates to the required power of the magnetic field that must be induced by fuze setter system 26 in fuze setter coil 34 to ensure reliable transmission of fuzing data to and from fuze 18 of shell 16. For instance, in the U.S. Navy Mk 34 fuze setter system, there is a one-inch distance between the setter coil and the fuze coil. Thus, for the U.S. Navy Mk 34 system, a minimum power of 103 milliwatts must be induced in the standard receiving coil at a distance of one-inch from fuze setter coil 34 for reliable transmission of fuzing data to and from the fuze of the shell.

The present invention is suitable for use in the U.S. Navy Mk 34 Mod 1 fuze setter system. Therefore, to further describe how the present invention is used, it will be assumed that a minimum threshold power level of 103 milliwatts is required to ensure reliable transfer of fuzing data from fuze setter system 26 to fuze setter coil 34, and thereby to fuze 18 of shell 16. The U.S. Navy Mk 34 fuze setter system typically induces about 125 milliwatts in the standard receiving coil at a distance of one inch from fuze setter coil 34.

Those skilled in the art will comprehend that the minimum power level required will vary, depending upon the configuration of the gun in use. For instance, for a gun having a distance other than one-inch between fuze setter coil 34 and fuze 18, a correspondingly different minimum power will be required by fuze setter coil 34 to reliably transfer fuzing data to and from fuze 18.

However, for any configuration of gun, a minimum power level must be induced in fuze setter coil 34 by fuze setter system 26 to ensure reliable fuzing of fuze 18. Therefore, it is desirable to indicate to an operator when the power level of fuze setter coil 34 is above the minimum threshold power level-here, for instance, 103 milliwatts when measured with the standard receiving coil at distance of one-inch from fuze setter coil 34.

Fuze setter system 26 thus transmits fuzing data to and from fuze 18 by fuze setter coil 34 During such fuzing, a magnetic field is generated in fuze setter coil 34. Induction element 46 is disposed adjacent to fuze setter coil 34 within groove 56 of coil form 20. Fuze setter coil 34 therefore induces an alternating current signal in induction element 46, and the power of the resultant magnetic field in induction element 46 corresponds to the power level induced in fuze setter coil 34. Thus, the power level of induction element 46 is also an indicator of the ability of fuze setter system 26 to reliably transmit fuzing data to and from fuze 18 of shell 16.

The alternating current signal generated in induction element 46 is sent to monitor circuitry 36. As described previously, monitor circuitry 36 receives the alternating current signal and converts it into an equivalent DC signal. From the previous description, those skilled in the art will appreciate that said DC signal is representative of the power level of fuze setter coil 34 and, in turn, the ability of fuze setter system 26 to reliably transmit fuzing data to and from fuze 18 of shell 16.

As also described previously, field strength comparator 104 compares the DC signal fed to said comparator's non-inverting input to a reference DC signal is fed to said comparator's inverting input by field strength calibrator 42. Field strength calibrator 42 includes a variable resistor 76. Variable resistor 76 is typically pre-calibrated using calibrator 38 so that resistor 70 and field strength calibrator 42 together feed a reference DC signal to the inverting input of field strength comparator 104.

Variable resistor 76 is adjusted during assembly of monitor circuitry 36 so field strength comparator 104 energizes LED 106 when a minimum of 110 milliwatts is generated by fuze setter system 26 in fuze setter coil 34. Typically, monitor circuitry 36 has about 2 milliwatts of hysteresis. Therefore, field strength comparator 104 operates to de-energize LED 106 when about 108 milliwatts is generated in fuze setter coil 34 by fuze setter system 26.

When energized by field strength comparator 104, LED 106 illuminates, and an operator is thereby informed that the power level of fuze setter coil 34 is adequate to ensure that fuzing data is being reliably transmitted by fuze setter system 26 to fuze 18 of shell 16. Additionally, LED 106 will, due to modulation of the carrier signal by fuze setter system 26, flash rapidly during forward data transfer from fuze setter system 26 to fuze 18 of shell 16. An operator will thereby be informed that forward fuzing data is being transferred from fuze setter system 26 to fuze 18 of shell 16.

Conversely, field strength comparator 104 is operable by monitor circuitry 36 to de-energize LED 106 when the power level of fuze setter coil 34 falls below 108 milliwatts. When de-energized, LED 106 extinguishes, an operator is thereby informed that the power level of fuze setter coil 34 is inadequate to ensure that fuzing data is being reliably transmitted by fuze setter system 26 to fuze 18 of shell 16.

Following fuzing by fuze setter system 26, shell 16 is further transported by gun mount 12 to the breech of gun 10 for firing. Gun mount 12 then operates to transport the next shell 16 to the transfer station 14, where the next shell 16 is briefly stopped at fuzing location 22 for fuzing.

As discussed previously, FIG. 1 illustrates several alternative embodiments of the present invention. In a first alternative embodiment of the present invention, hand power level monitor 110 comprises a hand power indicator 112 and an operational indicator 114. Hand power level monitor 110 is used by an operator placing the monitor in proximity to the fuze setter coil of a gun. Hand power level monitor 110 functions similarly to the preferred embodiment of the invention described above to energize or de-energize hand power indicator 112 and thereby indicate to an operator the adequacy of the power level of the fuze setter coil of the gun.

In a second alternative embodiment of the present invention, remote power indicator 38 is coupled by a remote cable 116 to power level monitor 24. Remote power indicator 38 operates like LED 106, and is used to remotely indicate to an operator the adequacy of the power level of fuze setter coil 34 to ensure that fuzing data is being reliably transmitted by fuze setter system 26 to fuze 18 of shell 16.

The previously described embodiments of the present invention have many advantages, including:

An advantage of the present invention is that it continuously indicates to an operator the adequacy of the power level generated by the fuze setter system in the fuze setter coil during operation of the gun, thereby indicating the ability of the fuze setter system to reliably transfer fuzing data to the fuze of the shell. Monitor circuitry 36 is operable to energize and de-energize LED 106, continuously during operation of gun 10, and thereby continuously indicate to an operator the adequacy of the power level of fuze setter system 26. In contrast, to use past systems, such as those described previously in the Background section of this application, shells 16 must be removed from gun mount 12 and gun 10 therefore cannot be fired or otherwise operated when measuring the adequacy of the power level of fuze setter system 26.

Another advantage of the present invention is to indicate to an operator the adequacy of the power level generated by the fuze setter system in the fuze setter coil during operation of the gun, wherein the indicator does not have to be adjusted or calibrated by an operator during use. Field strength comparator 104 automatically operates LED 106 to indicate the adequacy of the power level of fuze setter system 26. Variable resistor 76 of field strength calibrator 42 is calibrated during assembly of monitor circuitry 36, and thereby an operator is not required to adjust field strength comparator 104 or other components of monitor circuitry 36. As discussed previously, power indicator 50 is preferably a LED or similar indicator light or display. Accordingly, power indicator 50 is, by monitor circuitry 36, either energized (illuminated) or de-energized (not illuminated) to thereby indicate to an operator the adequacy of the power level of fuze setter coil 34. Accordingly, an operator does not have to adjust or calibrate power indicator 50.

Yet another advantage of the present invention is to indicate to an operator the adequacy of the power level generated by the fuze setter system in the fuze setter coil during operation of the gun without requiring removal of the shells from the gun mount. As described above, monitor circuitry 36 is operable to energize and de-energize LED 106 continuously during operation of gun 10, and thereby continuously indicate to an operator the adequacy of the power level of fuze setter system 26. The present invention is operable during operation of gun 10, even when gun 10 is being live-fired. In contrast, in past systems, such as those described previously in the Background section of the application, the shells 16 must be removed from gun mount 12, and gun 10 cannot be fired or otherwise operated when measuring the adequacy of the power level of fuze setter system 26.

Still another advantage of the present invention is to indicate to an operator the adequacy of the power level generated by the fuze setter system in the fuze setter coil during operation of the gun, without necessitating separate manual or computer-based tests or using specialized equipment. Induction element 46, monitor circuitry 36, power indicator 50 and other elements of the present invention are disposed within the existing structure of gun mount 12 of gun 10. In contrast, past systems, such as those described previously in the Background section of this application, require special test equipment, provided separately from gun mount 12 and fuze setter system 26, that is often bulky and difficult to transport and use.

Another advantage of the present invention is to indicate, during operation of the gun, to an operator when forward data is being transferred by the fuze setter system to the fuze of the shell. LED 106 is operable, due to modulation of the carrier signal by fuze setter system 26, to flash rapidly during forward data transfer from fuze setter system 26 to fuze 18 of shell 16. An operator will thereby be informed that forward fuzing data is being transferred from fuze setter system 26 to fuze 18 of shell 16. In contrast, in past systems, such as those described previously in the Background section of the application, the shells 16 must be removed from gun mount 12, and gun 10 cannot be fired or otherwise operated to indicate when forward data is being transferred from fuze setter system 26 to a standard receiving coil located in the position of shell 16.

An advantage of the present invention is also to provide remote or hand-held indication to an operator of the adequacy of the power level generated by the fuze setter system in the fuze setter coil during operation of the gun. Hand power level monitor 110 may be conveniently and inexpensively used by an operator to indicate the power of fuze setter coil 34. Remote indicator 38 inexpensively and conveniently remotely indicates to an operator the adequacy of the power level of fuze setter system 26. In contrast, past systems, such as the external manual or computer test sets described in the Background section supra, both require considerable expense and skill to use. For instance, skilled field services representatives must travel to the gun to use the external, manual or computer test sets. On the other hand, those skilled in the art will appreciate from examining the illustrative Parts List of monitor circuitry 36 described above, that the present invention is made from inexpensive commercially available components. No expensive manual or computer test sets, nor expensive field representatives are necessary to use the present invention.

There accordingly has been described an apparatus and process for continuously monitoring and indicating the magnetic field strength (power level) induced by a fuze setter system in the setter coil of a gun operable to fire inductively-fuzed shells. Gun mount 12 of gun 10 is configured to transport a shell 16 to transfer station 14, where shell 16 is briefly stopped at a fuzing location 22 for fuzing. Shell 16 includes a fuze 18 operable to receive and send fuzing data to a fuze setter system 26. Fuze setter system 26 comprises a setter unit assembly 28 connected to a ground 30. Setter unit assembly 28 is operable to send and receive a carrier signal comprising fuzing data to fuze 18 via cable 32 and a fuze setter coil 34. Fuze setter coil 34 is disposed within the coil form 20 of the power level monitor 24. Power level monitor 24 comprises induction element 46, monitor circuitry 36 and power indicator 50. Monitor circuitry 36 is operable to energize and de-energize power indicator 50, thereby conveniently, inexpensively and continuously indicating to an operator the adequacy of the power level of fuze setter system 26 to transmit fuzing data to fuze 18 of shell 16. The apparatus and process of the present invention thus enables an untrained operator to be continuously informed of power level status without necessitating calibration or adjustment of the components of the invention and without the need for expensive external test sets or skilled field representatives.

The reader's attention is directed to all papers and documents which are filed concurrently with this disclosure and which are open to public inspection with this specification, and the contents of all such papers and documents are incorporated herein by reference. All the features disclosed in this disclosure (including the accompanying claims, abstract and drawings) may be replaced by alternative features serving the same, equivalent or similar purpose unless expressly stated otherwise. Thus, unless expressly stated otherwise, each feature disclosed is but an example of a generic species of equivalent or similar features. Moreover, any element in a claim that does not explicitly state "means for" performing a specific function or "step for" performing a specific function is not be interpreted as a "means" or "step for" clause as specified by 35 U.S.C. 112 ¶6. In particular, any use of "step of" in the claims is not intended to invoke the provision of 35 U.S.C. 112 ¶6.

In this disclosure, there is shown and described only the preferred embodiment of the invention, but as aforementioned, it is to be understood that the invention is capable of use in various other combinations and environments and is capable of changes or modifications within the scope of the inventive concept expressed herein.

What is claimed is:

1. A power indicating setter system for inductively-fuzed munitions, the apparatus of the system comprising:

i) a housing;

ii) an induction element disposed adjacent to said housing and operable to sense a magnetic field in response to a carrier signal sent to a fuze setter coil;

iii) circuitry substantially disposed within said housing and coupled to said induction element, said circuitry configured to monitor the magnetic field strength sensed by said induction element in response to the carrier signal; and iv) a power indicator disposed upon said housing and operable by said circuitry to indicate when the magnetic field strength sensed by said induction element is greater than a calibrated value produced by said circuitry.

2. The power indicating setter system apparatus of claim 1, wherein said circuitry includes a field strength comparator for comparing the magnetic field value sensed by said induction element to the calibrated value produced by said circuitry.

3. The power indicating setter system apparatus of claim 2, wherein said field strength comparator includes at least one resistor for setting the calibrated value produced by said circuitry.

4. The power indicating setter system apparatus of claim 2, wherein said field strength comparator includes a variable resistor operable for varying the calibrated value produced by said circuitry.

5. The power indicating setter system apparatus of claim 2, wherein said power indicator is operable by said field strength comparator to indicate when the magnetic field value sensed by said induction element is greater than the calibrated value produced by said circuitry.

6. The power indicating setter system apparatus of claim 1, wherein said power indicator includes an indicator light.

7. The power indicating setter system apparatus of claim 6, wherein said indicator light is operable to indicate when the carrier signal is being forward modulated.

8. The power indicating setter system apparatus of claim 1, wherein said power indicator is located remotely from said housing.

9. The power indicating setter system apparatus of claim 1, wherein said induction element and the fuze setter coil are adjacently disposed upon said housing.

10. A power indicating setter system for inductively-fuzed munitions, the process of the system comprising the acts of:

i) inducing a magnetic field in an induction element;

ii) coupling said induction element to circuitry;

iii) configuring said circuitry to compare the value of the magnetic field to a calibrated value; and iv) indicating by said circuitry when the value of the magnetic field is greater than the calibrated value.

11. The power indicating setter system process of claim 10, wherein the act of inducing includes inducing the magnetic field in response to a carrier signal sent to a fuze setter coil.

12. The power indicating setter system process of claim 10, wherein the act of configuring further comprises the act of calibrating the calibrated value to a standard value.

13. The power indicating setter system process of claim 11, wherein the act of indicating further comprises indicating when the carrier signal is being forward modulated.

14. The power indicating setter system process of claim 11, wherein the act of inducing further comprises adjacently disposing said induction element and the fuze setter coil upon a housing.

15. The power indicating setter system process of claim 14, wherein the act of indicating is accomplished remotely from the housing.

16. A power indicating setter system for inductively-fuzed munitions comprising:

i) means for inducing a magnetic field in an induction element;

ii) means for coupling said induction element to circuitry;

iii) means for configuring said circuitry to compare the value of the magnetic field to a calibrated value; and iv) means for indicating by said circuitry when the value of the magnetic field is greater than the calibrated value.

17. The power indicating setter system of claim 16, wherein said means for inducing includes inducing the magnetic field in response to a carrier signal sent to a fuze setter coil.

18. The power indicating setter system of claim 16, wherein said means for configuring further comprises means for calibrating the calibrated value to a standard value.

19. The power indicating setter system of claim 17, wherein said means for indicating further comprises means for indicating when the carrier signal is being forward modulated.

20. The power indicating setter system of claim 17, wherein the means for inducing further comprises means for adjacently disposing said induction element and the fuze setter coil upon a housing.

* * * * *